US011483919B2

(12) United States Patent
Huang et al.

(10) Patent No.: US 11,483,919 B2
(45) Date of Patent: Oct. 25, 2022

(54) SYSTEM OF ELECTRON IRRADIATION

(71) Applicant: Huazhong University of Science and Technology, Hubei (CN)

(72) Inventors: Jiang Huang, Wuhan (CN); Lige Zhang, Wuhan (CN); Mingwu Fan, Wuhan (CN); Tiaoqin Yu, Wuhan (CN); Chen Zuo, Wuhan (CN); Yongqian Xiong, Wuhan (CN); Jun Yang, Wuhan (CN)

(73) Assignee: Huazhong University of Science and Technology, Wuhan (CN)

( * ) Notice: Subject to any disclaimer, the term of this patent is extended or adjusted under 35 U.S.C. 154(b) by 527 days.

(21) Appl. No.: 16/667,909

(22) Filed: Oct. 30, 2019

(65) Prior Publication Data

US 2020/0314995 A1 Oct. 1, 2020

Related U.S. Application Data

(63) Continuation of application No. PCT/CN2019/083309, filed on Apr. 18, 2019.

(30) Foreign Application Priority Data

Mar. 27, 2019 (CN) ..... 201910239390.0
Mar. 27, 2019 (CN) ..... 201910239420.8
(Continued)

(51) Int. Cl.
*H05H 7/04* (2006.01)
*H01F 7/02* (2006.01)

(52) U.S. Cl.
CPC ..... *H05H 7/04* (2013.01); *H01F 7/0278* (2013.01); *H05H 2007/043* (2013.01)

(58) Field of Classification Search
CPC .... H05H 7/04; H05H 2007/043; H05H 7/001; H05H 2007/007; H01F 7/0278
See application file for complete search history.

(56) References Cited

U.S. PATENT DOCUMENTS 2,844,754 A * 7/1958 Cioffi ..... H01J 23/0873 315/3.5
2,847,607 A * 8/1958 Pierce ..... H01J 23/0873 313/154
(Continued)

FOREIGN PATENT DOCUMENTS

CN 2337742 Y 9/1999
CN 1333462 A 1/2002
(Continued)

OTHER PUBLICATIONS

Lim J. K. et al: "Adjustable, short focal length permanent-magnet quadrupole based electron beam final focus system", Physical Review Special Topics—Accelerators and Beams, vol. 8, No. 7, Jul. 1, 2005 (Jul. 1, 2005), XP055787464.
(Continued)

*Primary Examiner* — David A Vanore
(74) *Attorney, Agent, or Firm* — Cooper Legal Group, LLC

(57) ABSTRACT

A system of electron irradiation includes an electron accelerator and an electron beam focusing device. The electron accelerator emits and accelerates a beam of electrons. The electron beam focusing device is located at a rear end of the electron irradiation and includes a beam restraining rail and 2n+1 sets of magnetic poles. The beam restraining rail forms a beam restraining channel through which the beam of electrons are to pass. The 2n+1 sets of magnetic poles are installed on the beam restraining rail and distributed at different locations of the beam restraining channel. An nth set of magnetic poles thereof are arranged for performing, on
(Continued)

the beam of electrons, focusing in a first direction. An (n+1)th set of magnetic poles thereof are arranged for performing, on the beam of electrons, focusing in a second direction. The second direction is perpendicular to the first direction. The n is a positive integer.

20 Claims, 14 Drawing Sheets

(30) Foreign Application Priority Data

Mar. 27, 2019 (CN) ..... 201910239421.2
Mar. 27, 2019 (CN) ..... 201910239970.X

(56) References Cited

U.S. PATENT DOCUMENTS

| | | | | | |
|---|---|---|---|---|---|
| 2,849,636 | A * | 8/1958 | Verhoef | H01J 29/68 | 335/212 |
| 3,071,707 | A * | 1/1963 | Schleich | H01J 37/065 | 315/14 |
| 3,259,787 | A * | 7/1966 | Fenton | H01J 23/0873 | 315/3.5 |
| 4,651,220 | A | 3/1987 | Hosoi | | |
| 4,916,404 | A | 4/1990 | Tsumaki | | |
| 5,621,214 | A | 4/1997 | Sofield | | |
| 6,182,831 | B1 * | 2/2001 | Scheidemann | H01J 49/30 | 250/281 |
| 6,403,955 | B1 * | 6/2002 | Senko | H01J 49/427 | 250/290 |
| 6,570,156 | B1 | 5/2003 | Tsuneta | | |
| 6,888,139 | B2 | 5/2005 | Tsuneta | | |
| 8,927,950 | B2 | 1/2015 | Gall et al. | | |
| 9,192,781 | B2 | 11/2015 | Ichihashi | | |
| 2002/0158736 | A1 * | 10/2002 | Gottschalk | H05H 7/04 | 335/306 |
| 2003/0201393 | A1 | 10/2003 | Tsuneta | | |
| 2004/0149904 | A1 * | 8/2004 | Scheidemann | H01J 49/025 | 250/282 |
| 2006/0232368 | A1 * | 10/2006 | Gorshkov | G01R 33/3806 | 335/306 |
| 2006/0232369 | A1 * | 10/2006 | Gorshkov | G01R 33/383 | 335/306 |
| 2011/0049377 | A1 | 3/2011 | Morf | | |
| 2012/0205534 | A1 * | 8/2012 | Hunter | H01J 49/0013 | 250/281 |
| 2012/0207372 | A1 | 8/2012 | Ichihashi | | |
| 2014/0094641 | A1 | 4/2014 | Gall et al. | | |
| 2015/0005567 | A1 | 1/2015 | Tsoupas | | |
| 2015/0129772 | A1 * | 5/2015 | Candler | H05H 9/005 | 250/396 ML |
| 2016/0226212 | A1 * | 8/2016 | Tajima | H01S 3/067 | |
| 2017/0265290 | A1 | 9/2017 | Shvartsman et al. | | |
| 2018/0343733 | A1 | 11/2018 | Mustapha | | |
| 2020/0273684 | A1 * | 8/2020 | Jurczyk | G21C 21/02 | |
| 2020/0314995 | A1 * | 10/2020 | Huang | H05H 7/001 | |

FOREIGN PATENT DOCUMENTS

| | | | | |
|---|---|---|---|---|
| CN | 2641816 | Y | 9/2004 | |
| CN | 101479634 | A | 7/2009 | |
| CN | 101834003 | A | 9/2010 | |
| CN | 101937729 | A | 1/2011 | |
| CN | 102054647 | A | 5/2011 | |
| CN | 102208226 | A | 10/2011 | |
| CN | 102426382 | A | 4/2012 | |
| CN | 102647849 | A | 8/2012 | |
| CN | 103026802 | A | 4/2013 | |
| CN | 104813748 | A | 7/2015 | |
| CN | 104991141 | A | 10/2015 | |
| CN | 105116437 | A | 12/2015 | |
| CN | 105530752 | A | 4/2016 | |
| CN | 106783466 | A | 5/2017 | |
| CN | 106954333 | A | 7/2017 | |
| CN | 107278013 | A | 10/2017 | |
| CN | 206574502 | U | 10/2017 | |
| CN | 108566721 | A | 9/2018 | |
| CN | 208541594 | U | 2/2019 | |
| CN | 109413832 | A | 3/2019 | |
| CN | 208590144 | U | 3/2019 | |
| EP | 0177973 | A2 | 4/1986 | |
| JP | H05181000 | A | 7/1993 | |
| JP | H05234550 | A | 9/1993 | |
| JP | H0660840 | A | 3/1994 | |
| JP | H0824080 | B2 | 3/1996 | |
| JP | 2000331637 | A | 11/2000 | |
| JP | 2004131567 | A | 4/2004 | |
| JP | 5602855 | B2 | 10/2014 | |
| JP | 2015106518 | A | 6/2015 | |
| JP | 2015207351 | A | 11/2015 | |
| WO | 2015169011 | A1 | 11/2015 | |
| WO | 2016075717 | A1 | 5/2016 | |
| WO | 2017198256 | A1 | 11/2017 | |
| WO | WO-2017198256 | A1 * | 11/2017 | H05H 7/04 |

OTHER PUBLICATIONS

Karpenko Victor et al: "An Engineering Overview of an Electrostatic Quadrupole Lattice for a High Current Transport Experiment 2 Electrostatic Quadrupoles 2.1 Mechanical Design Aspects I", Proceedings of the 2001 Particle Accelerator Conference, Jun. 1, 2001 (Jun. 1, 2001), pp. 1447-1449, XP055787499.

Partial Supplementary European Search Report in the European application No. 19816490.7, dated Mar. 31, 2021.

Shigeo Okayama, "Principles and applications of multi-quadrupole lenses (1)", Electron Microscope, 1990, and vol. 25, No. 1, pp. 31-35.

Tang Lisong, "Research of Debunching Device for Irradiation Processing", dated Jan. 15, 2018, A Thesis Submitted in Partial Fulfillment of the Requirements for the Degree for the Master of Engineering.

International Search Report in the international application No. PCT/CN2019/083309, dated Dec. 30, 2019.

Supplementary European Search Report in the European application No. 19816490.7, dated Jul. 30, 2021.

English translation of the Written Opinion of the International Search Authority in the international application No. PCT/CN2019/083309, dated Dec. 30, 2019.

* cited by examiner

D-D

SYSTEM OF ELECTRON IRRADIATION

CROSS-REFERENCE TO RELATED APPLICATIONS

This application is a continuation application of International patent application No. PCT/CN2019/083309, filed on Apr. 18, 2019, which is based on, and claims benefit of priority to, Chinese Application No. 201910239420.8, 201910239421.2, 201910239390.0, and 201910239970.X all filed on Mar. 27, 2019. Disclosure of the Chinese Applications is hereby incorporated by reference in its entirety.

TECHNICAL FIELD

The subject disclosure relates, but is not limited, to field of irradiation processing, and in particular to an electron beam focusing device.

BACKGROUND

There may be two types of sources of radiation for radiation processing. One may be a source of a radioactive isotope such as cobalt. The other may be an accelerator for accelerating charged particles such as electrons. An electron accelerator is advantageous as follows. Energy is controllable. A beam of electrons may essentially act on a product illuminated by the beam with high utilization. There is no issue of processing a source of radioactive waste. No electricity is consumed during shutdown. There is barely any pollution to the environment during the entire production except for a trace of ozone being produced. Consequently, more users tend to employ an electron accelerator in radiation processing.

During transmission of a beam of electrons accelerated in an electron accelerator, the greater a transverse envelope and a longitudinal envelope of the beam are, the greater a beam restraining loss, and the poorer the transmission performance of the beam restraining. In some cases, once production of an electron beam focusing device completes, then a performance parameter for the device to perform beam restraining on a beam of electrons is determined, failing to meet demands of focusing a beam of electrons in different application scenes.

SUMMARY

In view of this, at least one embodiment herein provides a system of electron irradiation.

A system of electron irradiation includes an electron accelerator and an electron beam focusing device.

The electron accelerator is arranged for emitting and accelerating a beam of electrons.

The electron beam focusing device is located at a rear end of the electron irradiation. The electron beam focusing device includes a beam restraining rail and 2n+1 sets of magnetic poles.

The beam restraining rail forms a beam restraining channel through which the beam of electrons are to pass.

The 2n+1 sets of magnetic poles are installed on the beam restraining rail. The 2n+1 sets of magnetic poles are distributed at different locations of the beam restraining channel. An nth set of magnetic poles of the 2n+1 sets of magnetic poles are arranged for performing, on the beam of electrons, focusing in a first direction. An (n+1)th set of magnetic poles of the 2n+1 sets of magnetic poles are arranged for performing, on the beam of electrons, focusing in a second direction. The second direction is perpendicular to the first direction. The n is a positive integer.

The 2n+1 sets of magnetic poles may include a first set of magnetic poles, a second set of magnetic poles, and a third set of magnetic poles.

The first set of magnetic poles may be arranged for performing, on the beam of electrons, first-time focusing in the first direction.

The second set of magnetic poles may be arranged for performing, on the beam of electrons, focusing in the second direction.

The third set of magnetic poles may be arranged for performing, on the beam of electrons, second-time focusing in the first direction.

At least part of the 2n+1 sets of magnetic poles may be movably installed on the beam restraining rail, with a spacing between any two neighbor sets of magnetic poles being adjustable.

Of the 2n+1 sets of magnetic poles, a second set of magnetic poles and/or a third set of magnetic poles may be movably installed on the beam restraining rail.

Different locations of the second set of magnetic poles on the beam restraining rail may correspond respectively to different first spacings between the second set of magnetic poles and a first set of magnetic poles of the 2n+1 sets of magnetic poles.

And/or, different locations of the third set of magnetic poles on the beam restraining rail may correspond respectively to different second spacings between the third set of magnetic poles and the second set of magnetic poles.

Different spacings between a first set of magnetic poles and a last set of magnetic poles of the 2n+1 sets of magnetic poles may correspond respectively to different lengths of a drift space in the beam restraining channel in which the beam of electrons drift.

The sets of magnetic poles may be sets of quadrupole magnetic poles.

The sets of quadrupole magnetic poles may be composed of permanent magnets.

The permanent magnets may be made from NdFeB.

A permanent magnet of the 2n+1 sets of magnetic poles may be installed on the beam restraining rail through a yoke ring.

The yoke ring may be made by connecting multiple yokes. Different connection locations between two neighbor yokes may correspond respectively to different diameters of the yoke ring.

The system may further include an electron beam detecting device arranged for detecting the beam of electrons.

The electron beam detecting device may include an electron collecting device, a sampling box, a communicating box, and a controller.

The electron collecting device may be located, together with the electron accelerator, inside a shield room. The electron collecting device may be arranged for acquiring a first signal by detecting a strength of the beam of electrons radiated by the electron accelerator.

The sampling box may be located inside the shield room. The sampling box may be connected to the electron collecting device. The sampling box may be arranged for receiving the first signal and converting the first signal into a second signal which is an optical signal that reflects a degree of uniformity of irradiation of the beam of electrons.

The communicating box may be located outside the shield room. The communicating box may be connected to the sampling box through an optical fiber. The communicating box may be arranged for receiving the second signal through the optical fiber and converting the second signal into a third signal which is an electric signal.

The controller may be located outside the shield room. The controller may be connected to the communicating box. The controller may be arranged for receiving the third signal and controlling detection of the beam of electrons.

The communicating box and the controller may be located inside a control room. A metal shield wall may be provided between the control room and the shield room.

A perforation through which the optical fiber is to pass may be provided on the metal shield wall.

The sampling box may include a current to voltage converting circuit, a digital to analog converter, a sampling chip, and a photoelectric converting circuit.

The current to voltage converting circuit may be connected to the electron collecting device. The current to voltage converting circuit may be arranged for receiving the first signal, which is a current signal, and converting the current signal into a voltage signal.

The digital to analog converter may be connected to the current to voltage converting circuit. The digital to analog converter may be arranged for converting the voltage signal, which may be an analog signal, into a digital signal.

The sampling chip may be connected to the digital to analog converter. The sampling chip may be arranged for converting the digital signal into a third signal that reflects the degree of uniformity of irradiation of the beam of electrons, The photoelectric converting circuit may be connected to the sampling chip. The photoelectric converting circuit may be arranged for converting the third signal into the second signal which is the optical signal.

The system may further include an electron collecting scaffold and a driving device.

The driving device may be connected to the electron collecting device.

The driving device may be arranged for providing the electron collecting device with a driving force.

The electron collecting device may be installed on the electron collecting scaffold. Driven by the driving force, the electron collecting device may move based on the electron collecting scaffold.

The electron collecting scaffold may include an electron collecting rail.

The electron collecting device may be movably installed on the electron collecting rail. The electron collecting device may be allowed of a one-dimensional movement along the electron collecting rail.

The driving device may include a stepper motor.

The electron collecting scaffold may be movably installed on an installation location of an irradiation processing production line.

If the electron collecting scaffold is located at a first location, the electron collecting device may be located on a processing location of the irradiation processing production line, and may be arranged for detecting the strength of the beam of electrons for irradiation processing. The processing location may be where a product is to be processed.

If the electron collecting scaffold is located at a second location, the electron collecting device may be located off the processing location.

With an electron beam focusing device according to at least one embodiment herein, an odd number of sets of magnetic poles may be installed on a beam restraining rail. Any set of magnetic poles of an odd ordinal number may focus the beam of electrons in a direction different from a direction in which any set of magnetic poles of an even ordinal number may focus the beam of electrons. As there may be an odd total number of sets of magnetic poles, a subsequent set of magnetic poles may focus the beam of electrons again to at least partially cancel out defocusing effect in the focusing direction of the set of magnetic poles under consideration brought about by a prior set of magnetic poles, thereby improving focusing effect of the electron beam focusing device, ultimately improving focus performance of the beam of electrons.

DETAILED DESCRIPTION

A technical solution of the subject disclosure is further elaborated below with reference to the drawings and embodiments.

Figure 1:
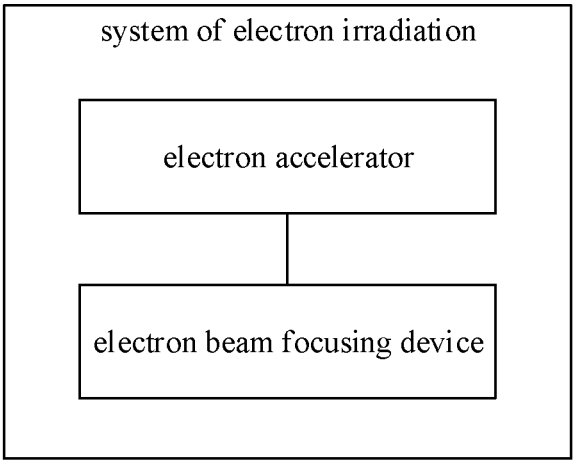
FIG. 1 is a diagram of a structure of a system of electron irradiation according to an embodiment herein.

As shown in FIG. 1, according to an embodiment, a system of electron irradiation may include an electron accelerator and an electron beam focusing device.

The electron accelerator may be arranged for emitting and accelerating a beam of electrons.

The electron beam focusing device may be located at a rear end of the electron irradiation. The electron beam focusing device may include a beam restraining rail and 2n+1 sets of magnetic poles.

The beam restraining rail may form a beam restraining channel through which the beam of electrons are to pass.

The 2n+1 sets of magnetic poles may be installed on the beam restraining rail. The 2n+1 sets of magnetic poles may be distributed at different locations of the beam restraining channel. An nth set of magnetic poles of the 2n+1 sets of magnetic poles may be arranged for performing, on the beam of electrons, focusing in a first direction. An (n+1)th set of magnetic poles of the 2n+1 sets of magnetic poles may be arranged for performing, on the beam of electrons, focusing in a second direction. The second direction may be perpendicular to the first direction. The n may be a positive integer.

A system of electron irradiation may include an accelerator capable of emitting a beam of electrons.

An electron accelerator may emit and accelerate electrons to form a beam of high-speed electrons. An electron beam focusing device may be located at a rear end of the electron accelerator. The electron beam focusing device may perform, on the beam of electrons through an odd number of sets of magnetic poles, an odd number of focusing operations in different directions, to at least partially cancel out defocusing effect in the focusing direction of the set of magnetic poles under consideration brought about by a prior set of magnetic poles, thereby improving focusing effect of the electron beam focusing device, ultimately improving focus performance of the beam of electrons.

As shown in FIG. 2 to FIG. 6, according to an embodiment, an electron beam focusing device may include a beam restraining rail and 2n+1 sets of magnetic poles.

The beam restraining rail may form a beam restraining channel through which the beam of electrons are to pass.

The 2n+1 sets of magnetic poles may be installed on the beam restraining rail. The 2n+1 sets of magnetic poles may be distributed at different locations of the beam restraining channel. An nth set of magnetic poles of the 2n+1 sets of magnetic poles may be arranged for performing, on the beam of electrons, focusing in a first direction. An (n+1)th set of magnetic poles of the 2n+1 sets of magnetic poles may be arranged for performing, on the beam of electrons, focusing in a second direction. The second direction may be perpendicular to the first direction. The n may be a positive integer.

With a structure of the electron beam focusing device according to an embodiment herein, a beam of electrons are focused, avoiding forming of a beam spot of an excessively large area by a beam of unfocused electrons caused by beam defocusing.

According to an embodiment, an electron beam focusing device may apply to an irradiation processing system. An electron beam focusing device contained in an irradiation processing system may be located at a rear end of an electron accelerator and a front end of a radiation processing device. The electron accelerator may generate a beam of electrons. The beam of electrons may be focused by the beam restraining channel formed by the electron beam focusing device. The beam of electrons may then uniformly reach a product to be processed by the radiation processing device.

Figure 2:
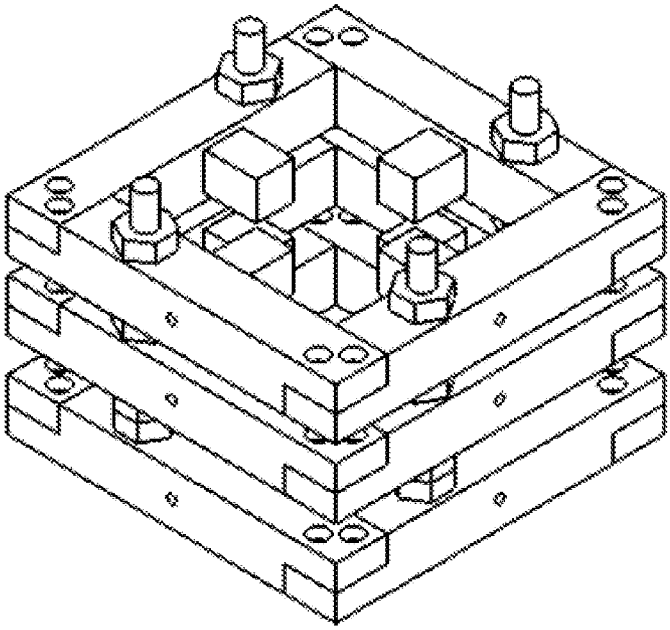
FIG. 2 is a diagram of a 3D structure of an electron beam focusing device according to an embodiment herein.

There may be multiple beam restraining rails. The multiple beam restraining rails may be distributed on both sides of the beam restraining channel. The multiple beam restraining rails may be distributed in a direction in which the beam restraining channel extends. In FIG. 2, a beam restraining rail may be a column threaded on the surface. The sets of magnetic poles may be secured using nuts at different locations.

Figure 3:
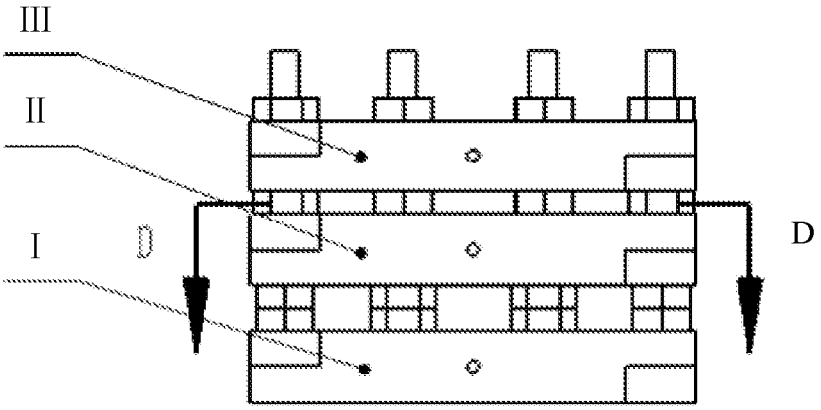
FIG. 3 is a diagram of a side structure of the electron beam focusing device according to an embodiment herein.

FIG. 2 and FIG. 3 show three sets of magnetic poles.

For example, a beam of electrons may move from a first end of the beam restraining channel towards a second end of the beam restraining channel. Distribution of the beam restraining rails may also extend from the first end towards the second end.

A beam of electrons may be composed of electrons. An electron per se may be a charged particle.

The sets of magnetic poles will form a magnetic field. A charged particle moving in a magnetic field will be subject to a magnetic field force. A magnetic field force may be applied to a beam of electrons using 2n+1 sets of magnetic poles. Effect of defocusing of the beam of electrons may be relieved through constraint of the magnetic field force, allowing the beam of electrons to focus.

A set of magnetic poles may include multiple magnets. The magnets may interact with each other to form a magnetic field that focuses the beam of electrons.

There may be an odd number of sets of magnetic poles. The odd number of sets of magnetic poles may be distributed at different locations of the beam restraining channel. The sets of magnetic poles may be arranged for performing, on the beam of electrons, focusing in at least two directions. The two directions may be perpendicular to each other.

For example, of two neighbor sets of magnetic poles, the first set of magnetic poles may perform, on the beam of electrons, focusing in the first direction. The second set of magnetic poles may perform, on the beam of electrons, focusing in the second direction.

There may be an odd number of sets of magnetic poles. If only 2 sets of magnetic poles were employed in focusing, while focusing the beam of electrons, the second set of magnetic poles would have defocused the beam of electrons in the focusing direction of the first set of magnetic poles. In the embodiment, after being focused by the secondary set in a different direction, the beam of electrons will be focused again, such that impact of focusing the beam of electrons in one direction the other direction may be reduced. Thus, with an electron beam focusing device containing 2n+1 sets of magnetic poles, a beam of electrons may be better focused, and a size of a beam spot of a beam of electrons formed may meet an expected trait in both the first direction and the second direction.

The n may be an arbitrary positive integer. Specifically, the n may range between 1 and 5. More specifically, the n may range between 1 and 3.

If the n is 1, then the electron beam focusing device has 3 sets of magnetic poles. The 3 sets of magnetic poles may be spaced at different locations of the beam restraining channel, and each restrain the beam of electrons in a separate direction.

The mth set of magnetic poles and the (m+2)th set of magnetic poles may focus the beam of electrons in one direction. The m may be a positive integer less than the n. To allow the (m+1)th set of magnetic poles to focus the beam of electrons in the other direction in spite of the (m+2)th set of magnetic poles, the strength of the magnetic field formed by the (m+2)th set of magnetic poles may be weaker than the strength of the magnetic field formed by the mth set of magnetic poles or the (m+1)th set of magnetic poles.

Of course, the strength of the magnetic field formed by the mth set of magnetic poles may be identical to the strength of the magnetic field formed by the (m+2)th set of magnetic poles. The strength of the magnetic field formed by the mth set of magnetic poles may as well be identical to the strength of the magnetic field formed by the (m+1)th set of magnetic poles.

The 2n+1 sets of magnetic poles may include a first set of magnetic poles, a second set of magnetic poles, and a third set of magnetic poles.

The first set of magnetic poles may be arranged for performing, on the beam of electrons, first-time focusing in the first direction.

The second set of magnetic poles may be arranged for performing, on the beam of electrons, focusing in the second direction.

The third set of magnetic poles may be arranged for performing, on the beam of electrons, second-time focusing in the first direction.

The n may equal 1. Then, there may be a total number of 3 sets of magnetic poles, i.e., the first set of magnetic poles, the second set of magnetic poles, and the third set of magnetic poles. The first set of magnetic poles and the third set of magnetic poles may be sets of magnetic poles of odd ordinal numbers, the second set of magnetic poles may be the set of magnetic poles of an even ordinal number. The third set of magnetic poles and the first set of magnetic poles may focus the beam of electrons in one direction, opposite to the direction in which the second magnetic pole may focus the beam of electrons.

After the first set of magnetic poles have performed, on the beam of electrons, the first-time focusing the first direction, the second set of magnetic poles may focus the beam of electrons in the second direction, which may defocus the beam of electrons in the first direction. To ensure that the beam of electrons is sufficiently focused in the first direction, the third set of magnetic poles may be used to perform, on the beam of electrons, the second-time focusing in the first direction, thereby at least partially cancelling out possible impact of the second set of magnetic poles on the focusing of the beam of electrons in the first direction.

For example, at least part of the 2n+1 sets of magnetic poles may be movably installed on the beam restraining rail. A spacing between any two neighbor sets of magnetic poles thereon may be adjustable.

Spacing among all or part of neighbor sets of magnetic poles may be adjustable. Therefore, once the number of the sets of magnetic poles is determined, spacing between the first set of magnetic poles and the last set of magnetic poles may be adjusted by adjusting spacing between two neighbor sets of magnetic poles. Therefore, a drifting space formed by the sets of magnetic poles in which the beam of electrons may drift may be adjustable, thereby meeting a demand for different drifting spaces for the beam of electrons.

The sets of magnetic poles may be movably installed on the beam restraining rail in at least one mode as follows:

A set of magnetic poles may be installed on the beam restraining rail through a clamping structure. The clamping structure may be in a first state or a second state. The clamping structure in the first state may secure the set of magnetic poles on the beam restraining rail. There may be at least one free end between the clamping structure in the second state and the beam restraining rail. In this case, the set of magnetic poles and the clamping structure may move, such as slide, on the beam restraining rail as a whole.

A set of magnetic poles may be movably installed on the beam restraining rail through a screw. Screw holes where the screw is to be screwed on or off may be provided at different locations of the beam restraining rail. The location of the set of magnetic poles on the beam restraining rail may be regulated by engaging the screw with threads of different screw holes, thereby regulating spacing between two neighbor sets of magnetic poles.

All 2n+1 sets of magnetic poles may be movably installed on the beam restraining rail. The location of any set of magnetic poles on the beam restraining rail may be adjustable.

In other embodiments, only part of the 2n+1 sets of magnetic poles may be movably installed on the beam restraining rail. For example, the 1st set of magnetic poles may be secured (i.e., fixedly installed) on the beam restraining rail. The remaining 2n+1 sets of magnetic poles may be movably installed on the beam restraining rail. The 1st set of magnetic poles may be secured at the first end of the beam restraining rail. The first end may be the part of the beam restraining rail that is connected to the electron accelerator. Secure installation of the 1st set of magnetic poles may facilitate a stable connection between the beam restraining rail and the electron accelerator.

Of the 2n+1 sets of magnetic poles, a second set of magnetic poles and/or a third set of magnetic poles may be movably installed on the beam restraining rail.

Different locations of the second set of magnetic poles on the beam restraining rail may correspond respectively to different first spacings between the second set of magnetic poles and a first set of magnetic poles of the 2n+1 sets of magnetic poles.

And/or, different locations of the third set of magnetic poles on the beam restraining rail may correspond respectively to different second spacings between the third set of magnetic poles and the second set of magnetic poles.

When the n is 1, of the three sets of magnetic poles, the first set of magnetic poles may be secured on the beam restraining rail, while the second set of magnetic poles and the third set of magnetic poles may be movably installed on the beam restraining rail. Then, the first spacing between the second set of magnetic poles and the first set of magnetic poles may be adjustable, and the second spacing between the third set of magnetic poles and the second set of magnetic poles may also be adjustable.

Thus, different spacings between a first set of magnetic poles and a last set of magnetic poles of the 2n+1 sets of magnetic poles may correspond respectively to different lengths of a drift space in the beam restraining channel in which the beam of electrons drift.

The sets of magnetic poles may be sets of quadrupole magnetic poles.

A set of quadrupole magnetic poles may contain 4 magnets.

A magnet may include but is not limited to an electromagnet, a permanent magnet, etc.

The sets of quadrupole magnetic poles may be composed of permanent magnets. Where permanent magnets are employed, a magnetic field may be formed without charging a set of magnetic poles. Meanwhile, wire and power consumption introduced by powering may be reduced.

For example, a set of quadrupole magnetic poles may include a first magnet, a second magnet, a third magnet, and a fourth magnet.

The first magnet may point its N pole towards the center of the beam restraining channel.

The second magnet may neighbor the first magnet, and may point its S pole towards the center of the beam restraining channel.

The third magnet may neighbor the second magnet neighbor. The second magnet may be located between the first magnet and the third magnet. The third magnet may point its N pole towards the center of the beam restraining channel.

The fourth magnet may neighbor both the third magnet and the first magnet, and may be located between the third magnet and the first magnet. The fourth magnet may point its S pole towards the center of the beam restraining channel.

The permanent magnets may be made from NdFeB.

A permanent magnet of the 2n+1 sets of magnetic poles may be installed on the beam restraining rail through a yoke ring.

The yoke ring may be composed of one or more yokes. The yoke ring may be a circular ring, a rectangular ring, an equilateral hexagonal ring, etc.

The material of yokes composing the yoke ring may include but is not limited to DT4.

The yoke ring may be made by connecting multiple yokes. Different connection locations between two neighbor yokes of the yoke ring may correspond respectively to different diameters of the yoke ring.

Multiple locations may be provided on a yoke. The multiple locations may serve to connect the yoke to a neighbor yoke. The diameter of the yoke ring may be changed by adjusting a connection location between two neighbor yokes. Thus, spacing between two magnets located one yoke ring may be adjustable, thereby regulating the area of a cross section of the beam restraining channel through which the beam of electrons may pass.

For example, the yoke ring may be a rectangular ring composed of 4 rectilinear yokes. The rectangular ring may include two sets of yokes. Each of the sets of yokes may be composed of yokes corresponding to a set of opposite sides of the rectangular ring. At least one set of yokes of the rectangular ring may be movable. Thus, the connection location with the other set of yokes may be adjusted, thereby adjusting the area of the cross section of the beam restraining channel.

As shown in FIG. 2 to FIG. 7, three sets of magnetic poles may be secured on the beam restraining rail through a rectangular yoke ring. In FIG. 2, a yoke ring I, a yoke ring II, and a yoke ring III are displayed.

Figure 4:
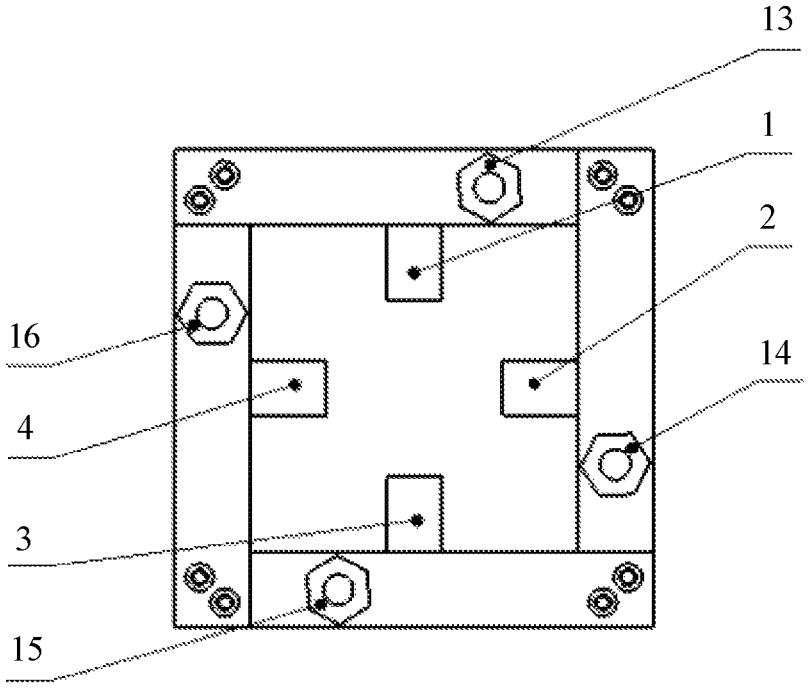
FIG. 4 to FIG. 6 are a diagram of a structure of the electron beam focusing device shown in FIG. 3, in a D-D section.

As shown in FIG. 4, the first set of quadrupole magnetic poles secured on the yoke ring I may include a magnet 1, a magnet 2, a magnet 3, and a magnet 4.

Figure 5:
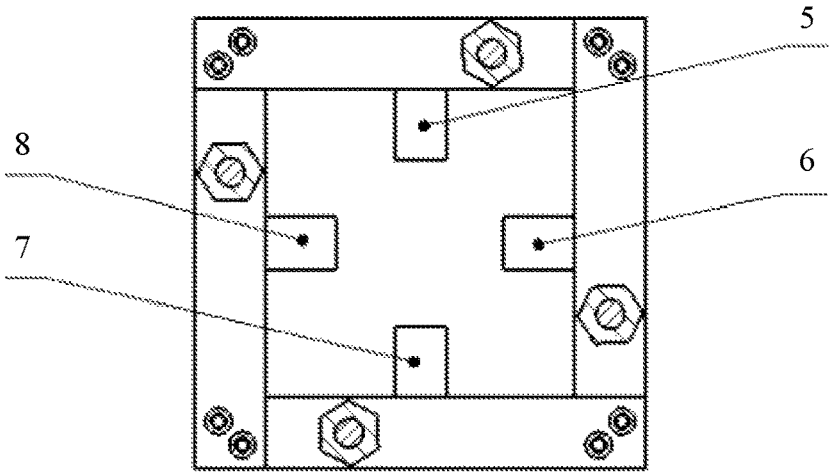

As shown in FIG. 5, the second set of quadrupole magnetic poles secured on the yoke ring II may include a magnet 5, a magnet 6, a magnet 7, and a magnet 8.

Figure 6:
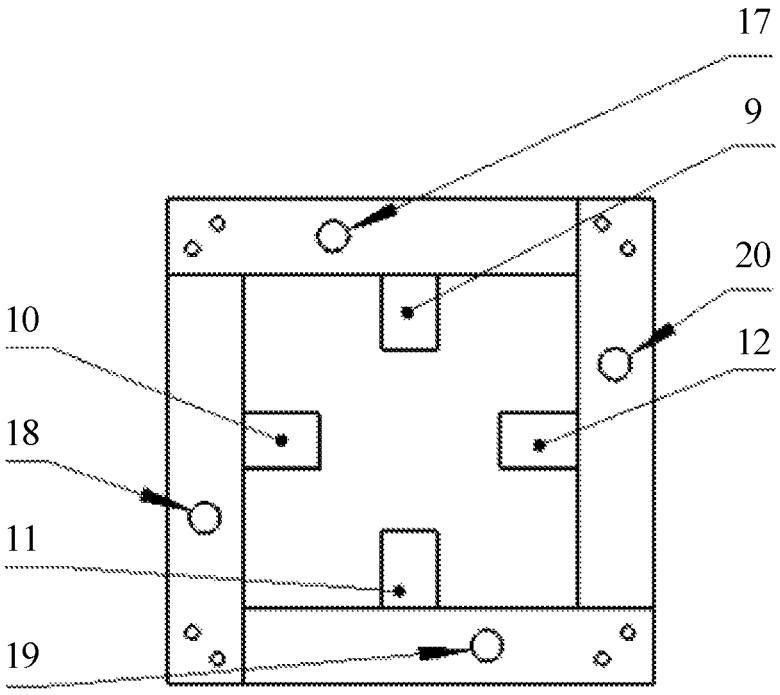

As shown in FIG. 6, the third set of quadrupole magnetic poles secured on the yoke ring III may include a magnet 9, a magnet 10, a magnet 11, and a magnet 12.

A through hole may be provided on the yoke ring. The beam restraining rail may pass through the through hole. Then, the yoke ring may be secured at a specific location of the beam restraining rail using a nut. For example, as shown in FIG. 3, the yoke ring I may be secured on the beam restraining rail using an adjusting screw 13, an adjusting screw 14, an adjusting screw 5, and an adjusting screw 16. As shown in FIG. 6, the yoke ring III may be provided with a through hole 17, a through hole 18, a through hole 19, and a through hole 20 for securing the yoke ring III on the beam restraining rail.

Two specific examples are provided below with reference to an aforementioned embodiment.

According to Example 1, a device for focusing a beam of electrons accelerated by an electron accelerator for irradiation may be provided. By combining three sets of permanent magnets of different parameters and the drift space, capability of the electron accelerator for irradiation to restrain and focus a beam may be strengthened, reducing the size of the envelope of the restrained beam as well as the size of the beam spot.

An electron beam focusing device may contain three sets of permanent magnets.

Each set of the permanent magnets may have four magnetic poles, and may be referred to as quadrupole magnets.

The first set of quadrupole magnets may mainly serve to focus the beam of electrons in the transverse direction X.

The second set of quadrupole magnets may mainly serve to focus the beam of electrons in the transverse direction Y.

The third set of magnets may serve to focus the beam of electrons again in the transverse direction X. Because of how quadrupole magnets implement focusing, while focusing the beam of electrons in the transverse direction Y, the second set of quadrupole magnets will inevitably defocus the restrained beam in the transverse direction X. Consequently, the second-time focusing in the transverse direction X may have to be performed on the beam of electrons to make up for the transverse defocusing action of the second set of magnets on the beamline, thereby allowing the restrained beam to be focused simultaneously in both transverse directions using the three sets of permanent magnets, reducing the size of the beam spot.

By combining the magnetic field formed by the three set of magnets and the length of the drift space properly, the restrained beam of the electron accelerator may be focused simultaneously in both transverse directions X and Y.

The magnetic poles may be made from NdFeB.

The yokes may be made from DT4.

Here, three sets of permanent magnets may be used. There is no electric energy consumption. The structure is simple. The manufacturing cost is low. Low operating efficiency and additional cost brought about by a power supply equipment failure are excluded. The beam restraining focusing system has good focusing performance. The acquired restrained beam is of excellent quality.

According to an embodiment, an electron beam detecting device may include an electron collecting scaffold 106, an electron collecting device, and a first driving device.

The electron collecting device 101 may be movably installed on the electron collecting scaffold 106. The electron collecting device may be arranged for moving along the electron collecting scaffold 106 as driven by a driving force.

The first driving device may be connected to the electron collecting device 101. The first driving device may be arranged for providing the electron collecting device 101 with the driving force required to move.

according to an embodiment herein, the electron collecting scaffold 106 in the electron beam detecting device may be movably installed to the electron collecting device 101. The electron collecting device may be able to move along the electron collecting scaffold 106. Thus, electrons may be collected at different locations of the electron collecting scaffold 106. Therefore, the degree of uniformity and/or the strength of radiation of the beam of electrons may be gathered.

As the electron collecting device 101 may be mobile with respect to the electron collecting scaffold 106, the electron collecting device may be able to detect beams of electrons at different locations, thereby reducing the number of electron collecting devices 101, lowering hardware cost.

The electron collecting device 101 may include but is not limited to a Faraday cup, an Aluminum rod, etc.

The first driving device may be an electric drive, a hydraulic drive, or a pneumatic drive. The electric drive may include various types of electric motors, such as a stepper motor, a linear motor, etc.

On one hand, the electron collecting scaffold 106 may provide the installation location the electron collecting device 101. On the other hand, the electron collecting scaffold may define the range in which the electron collecting device 101 may move.

The electron collecting scaffold may include an electron collecting rail 107. The electron collecting device 101 may be hung over the electron collecting rail 107. The electron collecting rail 107 may include a rail groove. The electron collecting device 101 may move on the rail groove. Or, the electron collecting rail 107 may be a rail pole. The electron collecting device 101 may move while covering the rail pole like a sleeve.

The electron collecting scaffold 106 may be a cross or a rectangular ring scaffold. The electron collecting device 101 may move in two dimensions where electrons are to be collected. The two dimensions may be perpendicular to each other, or may form a bevel.

As shown in FIG. 2 to FIG. 12, the electron collecting scaffold 106 may include an electron collecting rail 107.

The electron collecting device 101 may be movably installed on the electron collecting rail 107.

The electron collecting device may be allowed at least of a one-dimensional movement along the electron collecting rail 107.

The electron collecting scaffold 106 may be provided with the electron collecting rail 107 dedicated to movement of the electron collecting device 101.

The electron collecting device 101 may perform two-dimensional movement, three-dimensional movement or one-dimensional movement. For example, the electron collecting device 101 may move in the direction x and the direction y in a plane. The direction x may be perpendicular to the direction y. Then, such movement may be two-dimensional. For another example, the electron collecting device 101 may move in three-dimensional space, specifically in the direction x, the direction y, and the direction z. Any two of the direction x, the direction y, and the direction z may be perpendicular to each other.

The electron collecting device 101 may be provided with the electron collecting rail 107 for the electron collecting device 101 to perform one-dimensional movement. The electron collecting rail 107 may be a rectilinear rail. The rectilinear rail may specifically include a rectilinear groove, a rectilinear guide pole, etc.

The electron collecting scaffold 106 may be a movable scaffold.

When the movable scaffold is located at the first location with respect to the installation location of the movable scaffold, the electron collecting device 101 may be allowed to move within the first region.

When the movable scaffold is located at the second location with respect to the installation location of the movable scaffold, the electron collecting device 101 may be allowed to move within the second region.

The electron collecting scaffold 106 per se may also be a movable scaffold that may be allowed to move with respect to its installation location. The movable scaffold may be able to perform linear movement or rotation.

The movable scaffold may be a rotating scaffold that may rotate.

When being located at the first location and the second location with respect to its installation location, the movable scaffold may drag the electron collecting device 101 to get in and get out of the first region. Thus, although the electron collecting device 101 can perform only simple one-dimensional movement, the movement of the movable scaffold per se may allow the electron collecting device 101 to perform multidimensional movement in space.

The first region may be a processing region where an irradiated product is to be processed. The first region may be the region other than the processing region.

The first region may be the processing region where irradiation processing is to be performed on a product. Thus, by staying out of the first region, the electron collecting device 101 may avoid interfering with the ongoing irradiation processing. In detecting the beam of electrons for irradiation processing, the electron collecting device may enter the first region to perform normal detection of the beam of electrons for irradiation.

The L-shaped movable scaffold may include a first scaffold body. The first scaffold body may include a secured end and a free end opposite to the secured end. The secured end may be secured on the installation location. The L-shaped movable scaffold may include a second scaffold body. The second scaffold body may be connected to the free end of the first scaffold body. The second scaffold body may be movably connected to the electron collecting device 101.

The movable scaffold may be an L-shaped rotating right angle. The movable scaffold may have a free end and a secured end. The secured end may serve to be secured on the installation location of the movable scaffold. The free end may rotate around the secured end.

The movable scaffold may be L-shaped. The movable scaffold may be a first scaffold and a second scaffold. The first scaffold and the second scaffold may form a right angle of 90 degrees or an angle of nearly 90 degrees. Thus, on one hand, compared to a rectilinear scaffold, the movable scaffold may take up less space in one dimension, facilitating flexible layout of equipment in a factory. On the other hand, the movable scaffold may consist of two scaffolds forming a right angle, such that the electron collecting device 101 may access the first region flexibly and easily while reducing the overall rotating angle of the movable scaffold, reducing the large space required by the large rotating angle, again facilitating flexible layout of the factory.

The movable scaffold may switch from being in the first location to being in the second location. The movable scaffold may rotate 90 degrees about the secured end where the movable scaffold is installed.

The system may further include a second driving device.

The second driving device may be connected to the movable scaffold. The second driving device may be arranged for providing a driving force for moving the movable scaffold.

The second driving device may drive the movable scaffold to rotate. The second driving device may as well be an electric drive or a hydraulic drive.

As shown in FIG. 2 and FIG. 3, the electron collecting device 101 may be located, together with the electron accelerator, inside a shield room. The electron collecting device may be arranged for acquiring a first signal by detecting a strength of the beam of electrons radiated by the electron accelerator.

The sampling box may be located inside the shield room. The sampling box may be connected to the electron collecting device 101. The sampling box may be arranged for receiving the first signal and converting the first signal into a second signal. The second signal may be an optical signal that reflects a degree of uniformity of irradiation of the beam of electrons.

The communicating box 103 may be located outside the shield room. The communicating box may be connected to the sampling box through an optical fiber 105. The communicating box may be arranged for receiving the second signal through the optical fiber 105, and converting the second signal into a third signal which is an electric signal.

The controller 104 may be located outside the shield room. The controller may be connected to the communicating box 103. The controller may be arranged for receiving the third signal and controlling detection of the beam of electrons.

According to an embodiment herein, the electron beam detecting device may apply to high current irradiation processing.

The electron collecting device 101 may include but is not limited to a Faraday cup, an Aluminum rod, etc. A hollow cavity may be provided inside the electron collecting device 101. With the hollow cavity, the amount of incident charged particles may be detected, thereby detecting the strength of the beam of electrons at a single point in time.

The first signal may be proportional to the number of electrons incident onto the electron collecting device 101 at a single time point.

To reduce inaccuracy of the detected degree of uniformity of irradiation of the beam of electrons due to interference of the beam of electrons of high current on work of equipment such as the controller 104, a shield room may be introduced in the electron beam detecting device. Both the electron collecting device 101 and the sampling box may be provided inside the shield room. Thus, the large current generated by the beam of electrons of high current may be isolated inside the isolating room, reducing risk of breakdown of air by the large current or failure of the communicating box 103, the controller 104, etc., under interference in an environment of a large depth.

To reduce interference of the beam of electrons of high current on the sampling signal inside the shield room, upon acquiring the first signal, the sampling box may convert the first signal right away into the second signal that is an optical signal. An optical signal may be conducted by broadcast, instead of as an electric signal such as a voltage signal or a current signal, and thereby will not be subject to interference of the beam of electrons of high current. Thus, the controller 104 per se will not be subject to interference. Meanwhile, the signal may be subject to less interference during transmission, thereby improving accuracy in detecting the beam of electrons.

The sampling box may acquire the current sampling signal by sampling the current on the electron collecting device 101 at predetermined intervals. The predetermined intervals may include identical intervals of an arbitrary duration. Then, the sampling box will periodically sample the current signal on the electron collecting device 101. If the predetermined intervals include at least two different intervals, then the sampling box may gather the current signal on the electron collecting device 101 in time sequence at predetermined intervals.

The communicating box 103 may be a photoelectric converting device that converts an optical signal into an electric signal.

The communicating box 103 and the controller 104 may be integrated equipment. That is, the communicating box 103 and the controller 104 may be located in one housing and belong to one piece of physical equipment, such as a server capable of transceiving an optical signal, etc.

The communicating box 103 and the controller 104 may be physical equipment independent of each other.

Interference of the beam of electrons of a large current on the detected signal may be reduced by using an isolating room and transmitting the signal using an optical fiber 105 instead of a cable, thereby improving accuracy in detecting the beam of electrons.

The communicating box 103 and the controller 104 may be located inside a control room. A metal shield wall may be provided between the control room and the shield room.

A perforation through which the optical fiber 105 is to pass may be provided on the metal shield wall.

The isolating room may have at least one isolating wall. The isolating wall may have the communicating box 103 and outside the control room. For example, the isolating room may have one or more isolating walls. For example, the isolating room may have 2 to 4 isolating walls.

The isolating wall may be provided with a metal board, metal powder, etc., that forms a metal shield layer. Thus, an electric signal may be guided into the ground by the metal. Or, the alternating electromagnetic field generated by the beam of electrons of alternating high current may further be isolated inside the isolating room by a metal isolating layer, reducing interference of such alternating electromagnetic field on the communicating box 103 and/or the controller 104 inside the control room.

As shown in FIG. 4, the sampling box may include a current to voltage converting circuit, a digital to analog converter, a sampling chip, and a photoelectric converting circuit.

The current to voltage converting circuit may be connected to the electron collecting device 101. The current to voltage converting circuit may be arranged for receiving the first signal, which may be a current signal. The current to voltage converting circuit may be arranged for converting the current signal into a voltage signal.

The digital to analog converter may be connected to the current to voltage converting circuit. The digital to analog converter may be arranged for converting the voltage signal, which may be an analog signal, into a digital signal.

The sampling chip may be connected to the digital to analog converter. The sampling chip may be arranged for converting the digital signal into a third signal that reflects the degree of uniformity of irradiation of the beam of electrons.

The photoelectric converting circuit may be connected to the sampling chip. The photoelectric converting circuit may be arranged for converting the third signal into the second signal which may be the optical signal.

The current to voltage converting circuit may be connected to the electron collecting device 101. The current to voltage converting circuit naturally will guide, into the sampling box, the current formed while the electron collecting device 101 accepts radiation of the beam of electrons intruding onto the electron collecting device 101. The current to voltage converting circuit may convert the current signal into the voltage signal of a value corresponding to the value of the current signal. The voltage signal may be referred to as so to distinguish it from another voltage signal. Here the "first" in the name of the voltage signal may not have any material meaning. The first signal may refer in general to the current signal received by the current to voltage converting circuit from the electron collecting device 101.

The voltage signal formed by the current to voltage converting circuit may be an analog signal.

The sampling box may further include a digital to analog converter. The digital to analog converter may acquire the digital signal by discretization of the analog signal. The sampling chip on one hand may control the signal sampling by the sampling box, and on the other hand may control the signal conversion by the sampling box.

The sampling chip may include a programmable array. The programmable circuit may include but is not limited to a Field-Programmable Gate Array (FPGA) and/or a complex programmable array.

The sampling chip may further include a microprocessor or an Application Specific Integrated Circuit (ASIC). In short, the sampling chip may be a microcontroller 104 or a micro controlling circuit of various forms located in the sampling box. The sampling chip may convert, through signal conditioning, the strength of the signal at a single point in time into the strength of the signal containing multiple single points for comparison, conversion, etc., to acquire the degree of uniformity of irradiation of the beam of electrons within the period of the signal of the multiple single points.

The sampling chip may further serve to amplify a signal, filter an interfering signal, etc. By signal amplification, a weak signal may be converted into a strong signal, thereby reducing signal loss due to attenuation, etc., during transmission.

Meanwhile, the sampling chip may also filter an interfering signal. The interfering signal may be filtered out through difference in the signal frequency, thereby improving the signal to noise ratio of the signal, again improving accuracy of a subsequent result detected.

The sampling box may further include a photoelectric converting circuit. The sampling chip may acquire, using the digital signal gathered at a single time point, the third signal that measures the degree of uniformity of irradiation of the beam of electrons within a period of time. The third signal may be a signal such as a voltage pulse. The photoelectric converting circuit will convert the received electric signal into an optical signal. The optical signal may be referred to as the second electric signal. The second electric signal may be transmitted to the communicating box 103 via the optical fiber 105.

The optical fiber 105 may include but is not limited to a single mode optical fiber 105 or a multimode optical fiber 105. There may be one or more optical fibers 105. The bandwidth of the optical fiber 105 may be provided as demanded by the amount of data to be transmitted.

In short, in at least one embodiment herein, the electron collecting scaffold 106 may be movably installed on an irradiation processing production line. Such movable installation may allow the electron collecting scaffold 106 to move on the irradiation processing production line. For example, the electron collecting scaffold 106 may be moved, such that the electron collecting device 101 is moved from the location A to the location B. The electron collecting device 101 may be driven by the electron collecting scaffold 106 to get in and get out of the processing location where a product is to be processed. If the electron collecting device 101 has entered the processing location, then the electron collecting device instead of the product being processed may experience irradiation of the beam of electrons. If the electron collecting device has left the processing location, then the processing location becomes available, so that a product to be processed may be placed there and irradiation processing may continue.

The electron collecting scaffold 106 may be, but is not limited to, a mechanical arm capable of carrying the electron collecting device 101 to move.

According to Example 2, an electron beamline focusing device for irradiation processing industry may contain three sets of permanent magnets. The four magnets 1 to 4 of the first set of permanent magnets may be secured onto the yoke I. The yoke I may be secured on the rail, and may serve to focus the incident beamline in the transverse direction X. The four magnetic poles 5~8 of the second set of permanent magnets may be secured onto the yoke II. The yoke II may adjust the location of the set of magnets back and forth using adjusting screws 13 to 16 and by cooperating with the rails inserted in the through holes 17 to 20, to focus the incident beamline in the transverse direction Y. The four magnetic poles 9~12 of the third set of permanent magnets may be secured onto the yoke III. Likewise, the yoke III may adjust the location of the quadrupole magnets back and forth using adjusting screws 13~16 and by cooperating with the rails inserted in the through holes 17~20.

The length of the drift space of the restrained beam may be altered by adjusting the locations of the second set of permanent magnets and the third set of permanent magnets. Beams of electrons restrained with different parameters may be focused by combining drift spaces of different lengths and the locations of the permanent magnets.

Figure 7:
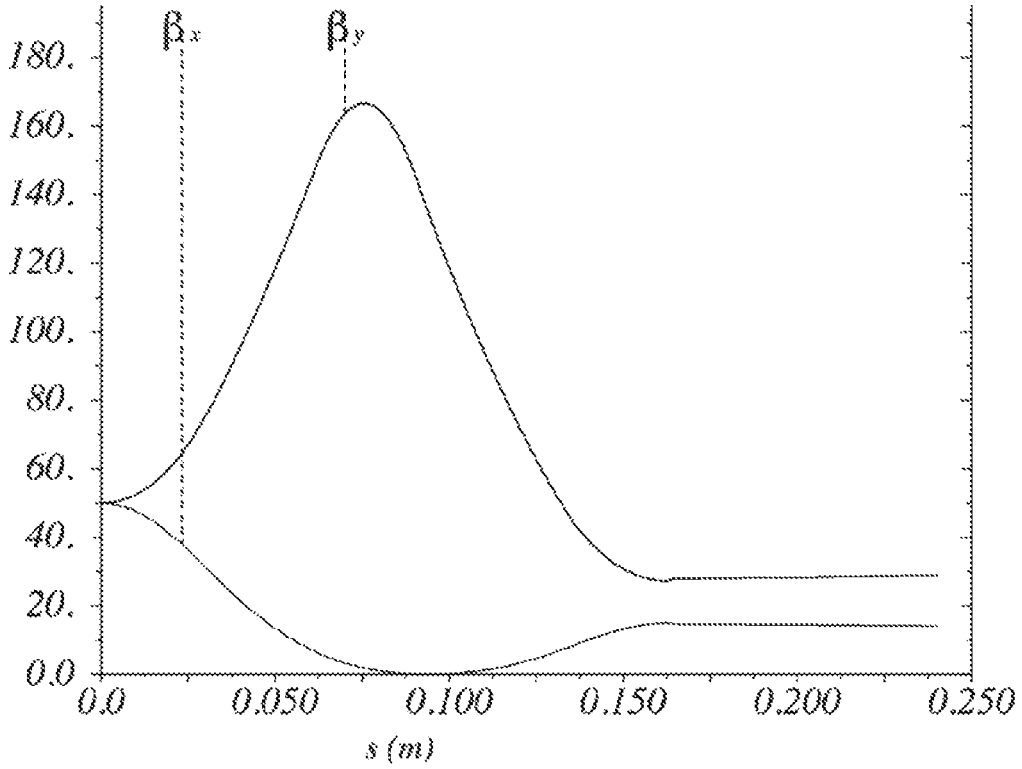
FIG. 7 is a diagram of effect of a parameter β of an electron beam focusing device according to an embodiment herein.

FIG. 7 is the change in the parameter β of the device when the restrained beam of electrons of energy of emittance passes through the device according to the example. The parameter β may be the envelope of the amplitude of the restrained beam during transmission. The parameter may reflect focus performance of the beamline. It may be seen that with the example, the restrained beam may be focused in both the transverse directions X and Y by combining three sets of permanent magnets and the drift spaces.

In FIG. 7, the horizontal axis may be the length of space (in units of m) in which the beam of electrons drift; and the vertical axis may be the parameter β of the drifting beam of electrons. In FIG. 7, the parameter β in the direction X may be $\beta_x$. and the parameter β in the direction Y may be $\beta_y$. It may be seen in FIG. 7 that values of the parameter β in both the direction X and the direction Y are small, achieving ideal beam restraining effect (i.e., focusing effect).

The system of electron irradiation may further include an electron beam detecting device arranged for detecting the beam of electrons.

Figure 8:
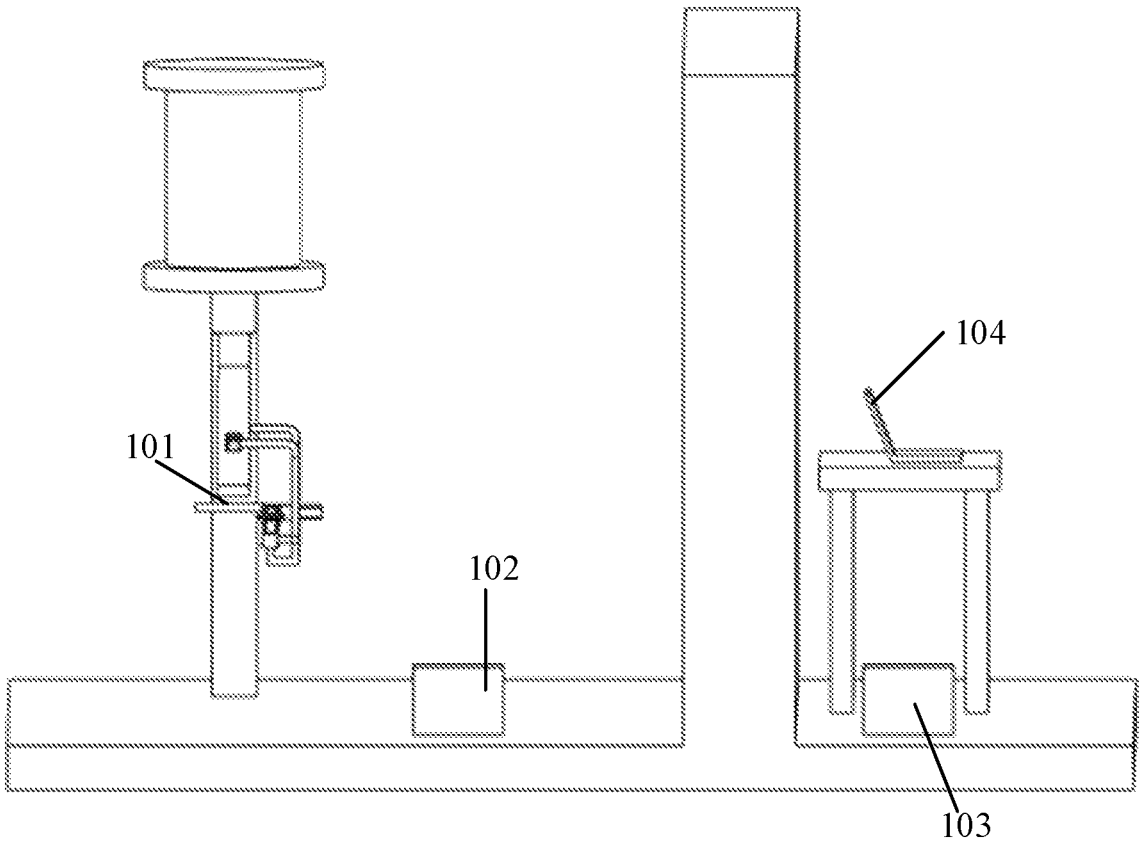
FIG. 8 is a diagram of a structure of an electron beam detecting device according to an embodiment herein.
Figure 9:
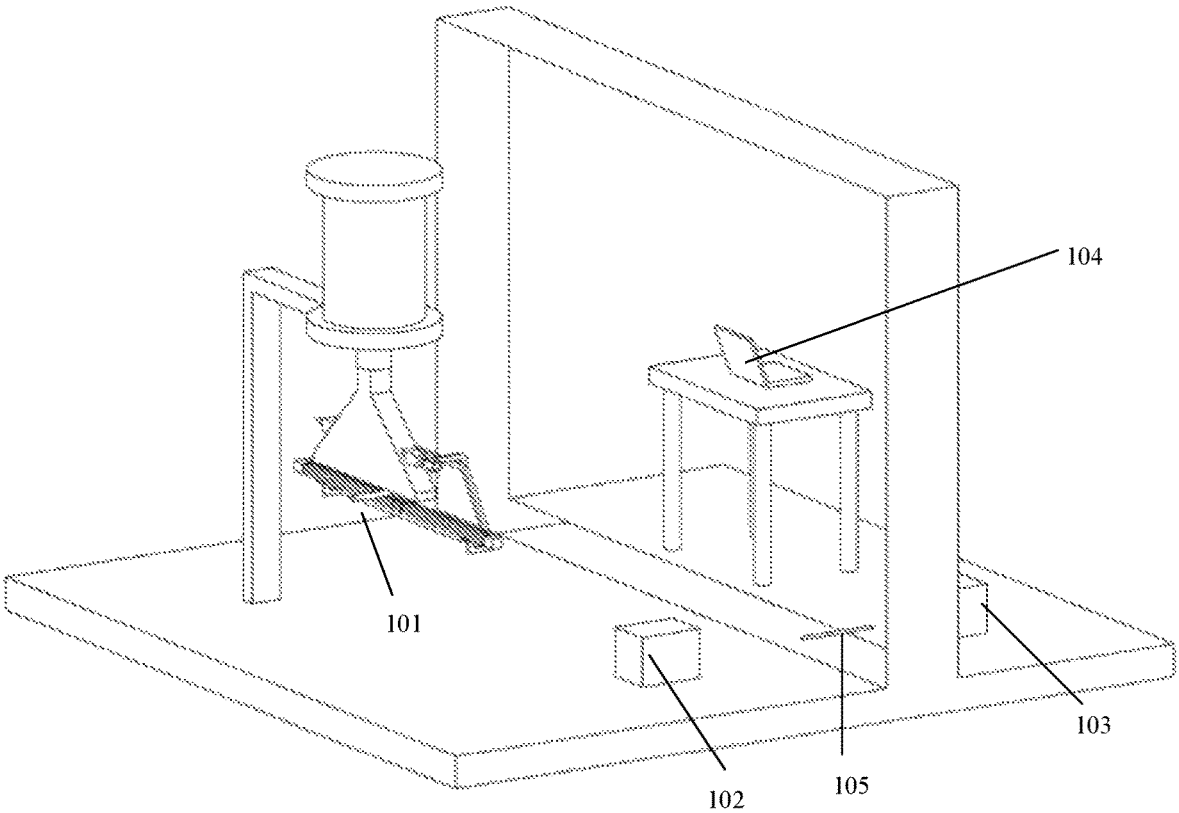
FIG. 9 is a diagram of a structure of an electron beam detecting device according to an embodiment herein.

As shown in FIG. 8 and FIG. 9, according to an embodiment, the electron beam detecting device may include an electron collecting device, a sampling box, a communicating box, and a controller.

The electron collecting device 101 may be located, together with the electron accelerator, inside a shield room. The electron collecting device may be arranged for acquiring a first signal by detecting a strength of the beam of electrons radiated by the electron accelerator.

The sampling box 102 may be located inside the shield room. The sampling box may be connected to the electron collecting device 101. The sampling box may be arranged for receiving the first signal and converting the first signal into a second signal. The second signal may be an optical signal that reflects a degree of uniformity of irradiation of the beam of electrons.

The communicating box 103 may be located outside the shield room. The communicating box may be connected to the sampling box 102 through an optical fiber 105. The communicating box may be arranged for receiving the second signal through the optical fiber 105, and converting the second signal into a third signal which is an electric signal.

The controller 104 may be located outside the shield room. The controller may be connected to the communicating box 103. The controller may be arranged for receiving the third signal and controlling detection of the beam of electrons.

According to an embodiment herein, the electron beam detecting device may apply to high current irradiation processing.

The electron collecting device 101 may include but is not limited to a Faraday cup, an Aluminum rod, etc. A hollow cavity may be provided inside the electron collecting device 101. With the hollow cavity, the amount of incident charged particles may be detected, thereby detecting the strength of the beam of electrons at a single point in time.

The first signal may be proportional to the number of electrons incident onto the electron collecting device 101 at a single time point.

To reduce inaccuracy of the detected degree of uniformity of irradiation of the beam of electrons due to interference of the beam of electrons of high current on work of equipment such as the controller 104, a shield room may be introduced in the electron beam detecting device. Both the electron collecting device 101 and the sampling box 102 may be provided inside the shield room. Thus, the large current generated by the beam of electrons of high current may be isolated inside the isolating room, reducing risk of breakdown of air by the large current or failure of the communicating box 103, the controller 104, etc., under interference in an environment of a large depth.

To reduce interference of the beam of electrons of high current on the sampling signal inside the shield room, upon acquiring the first signal, the sampling box 102 may convert the first signal right away into the second signal that is an optical signal. An optical signal may be conducted by broadcast, instead of as an electric signal such as a voltage signal or a current signal, and thereby will not be subject to interference of the beam of electrons of high current. Thus, the controller 104 per se will not be subject to interference. Meanwhile, the signal may be subject to less interference during transmission, thereby improving accuracy in detecting the beam of electrons.

The sampling box 102 may acquire the current sampling signal by sampling the current on the electron collecting device 101 at predetermined intervals. The predetermined intervals may include identical intervals of an arbitrary duration. Then, the sampling box 102 will periodically sample the current signal on the electron collecting device 101. If the predetermined intervals include at least two different intervals, then the sampling box 102 may gather the current signal on the electron collecting device 101 in time sequence at predetermined intervals.

The communicating box 103 may be a photoelectric converting device that converts an optical signal into an electric signal.

The communicating box 103 and the controller 104 may be integrated equipment. That is, the communicating box 103 and the controller 104 may be located in one housing and belong to one piece of physical equipment, such as a server capable of transceiving an optical signal, etc.

The communicating box 103 and the controller 104 may be physical equipment independent of each other.

Interference of the beam of electrons of a large current on the detected signal may be reduced by using an isolating room and transmitting the signal using an optical fiber 105 instead of a cable, thereby improving accuracy in detecting the beam of electrons.

The communicating box 103 and the controller 104 may be located inside a control room. A metal shield wall may be provided between the control room and the shield room.

A perforation through which the optical fiber 105 is to pass may be provided on the metal shield wall.

The isolating room may have at least one isolating wall. The isolating wall may isolate the communicating box 103 to the control room. For example, the isolating room may have one or more isolating walls. For example, the isolating room may have 2 to 4 isolating walls.

The isolating wall may be provided with a metal board, metal powder, etc., that forms a metal shield layer. Thus, an electric signal may be guided into the ground by the metal. Or, the alternating electromagnetic field generated by the beam of electrons of alternating high current may further be isolated inside the isolating room by a metal isolating layer, reducing interference of such alternating electromagnetic field on the communicating box 103 and/or the controller 104 inside the control room.

The sampling box 102 may include a current to voltage converting circuit, a digital to analog converter, a sampling chip, and a photoelectric converting circuit.

The current to voltage converting circuit may be connected to the electron collecting device 101. The current to voltage converting circuit may be arranged for receiving the first signal, which may be a current signal. The current to voltage converting circuit may be arranged for converting the current signal into a voltage signal.

The digital to analog converter may be connected to the current to voltage converting circuit. The digital to analog converter may be arranged for converting the voltage signal, which may be an analog signal, into a digital signal.

The sampling chip may be connected to the digital to analog converter. The sampling chip may be arranged for converting the digital signal into a third signal that reflects the degree of uniformity of irradiation of the beam of electrons.

The photoelectric converting circuit may be connected to the sampling chip. The photoelectric converting circuit may be arranged for converting the third signal into the second signal which may be the optical signal.

The current to voltage converting circuit may be connected to the electron collecting device 101. The current to voltage converting circuit naturally will guide, into the sampling box 102, the current formed while the electron collecting device 101 accepts radiation of the beam of electrons intruding onto the electron collecting device 101. The current to voltage converting circuit may convert the current signal into the voltage signal of a value corresponding to the value of the current signal. The voltage signal may be referred to as so to distinguish it from another voltage signal. Here the "first" in the name of the voltage signal may not have any material meaning. The first signal may refer in general to the current signal received by the current to voltage converting circuit from the electron collecting device 101.

The voltage signal formed by the current to voltage converting circuit may be an analog signal.

The sampling box 102 may further include a digital to analog converter. The digital to analog converter may acquire the digital signal by discretization of the analog signal. The sampling chip on one hand may control the signal sampling by the sampling box 102, and on the other hand may control the signal conversion by the sampling box 102.

The sampling chip may include a programmable array. The programmable circuit may include but is not limited to a Field-Programmable Gate Array (FPGA) and/or a complex programmable array.

The sampling chip may further include a microprocessor or an Application Specific Integrated Circuit (ASIC). In short, the sampling chip may be a microcontroller 104 or a micro controlling circuit of various forms located in the sampling box 102. The sampling chip may convert, through signal conditioning, the strength of the signal at a single point in time into the strength of the signal containing multiple single points for comparison, conversion, etc., to acquire the degree of uniformity of irradiation of the beam of electrons within the period of the signal of the multiple single points.

The sampling chip may further serve to amplify a signal, filter an interfering signal, etc. By signal amplification, a weak signal may be converted into a strong signal, thereby reducing signal loss due to attenuation, etc., during transmission.

Meanwhile, the sampling chip may also filter an interfering signal. The interfering signal may be filtered out through difference in the signal frequency, thereby improving the signal to noise ratio of the signal, again improving accuracy of a subsequent result detected.

The sampling box 102 may further include a photoelectric converting circuit. The sampling chip may acquire, using the digital signal gathered at a single time point, the third signal that measures the degree of uniformity of irradiation of the beam of electrons within a period of time. The third signal may be a signal such as a voltage pulse. The photoelectric converting circuit will convert the received electric signal into an optical signal. The optical signal may be referred to as the second electric signal. The second electric signal may be transmitted to the communicating box 103 via the optical fiber 105.

The optical fiber 105 may include but is not limited to a single mode optical fiber 105 or a multimode optical fiber 105. There may be one or more optical fibers 105. The bandwidth of the optical fiber 105 may be provided as demanded by the amount of data to be transmitted.

Figure 11:
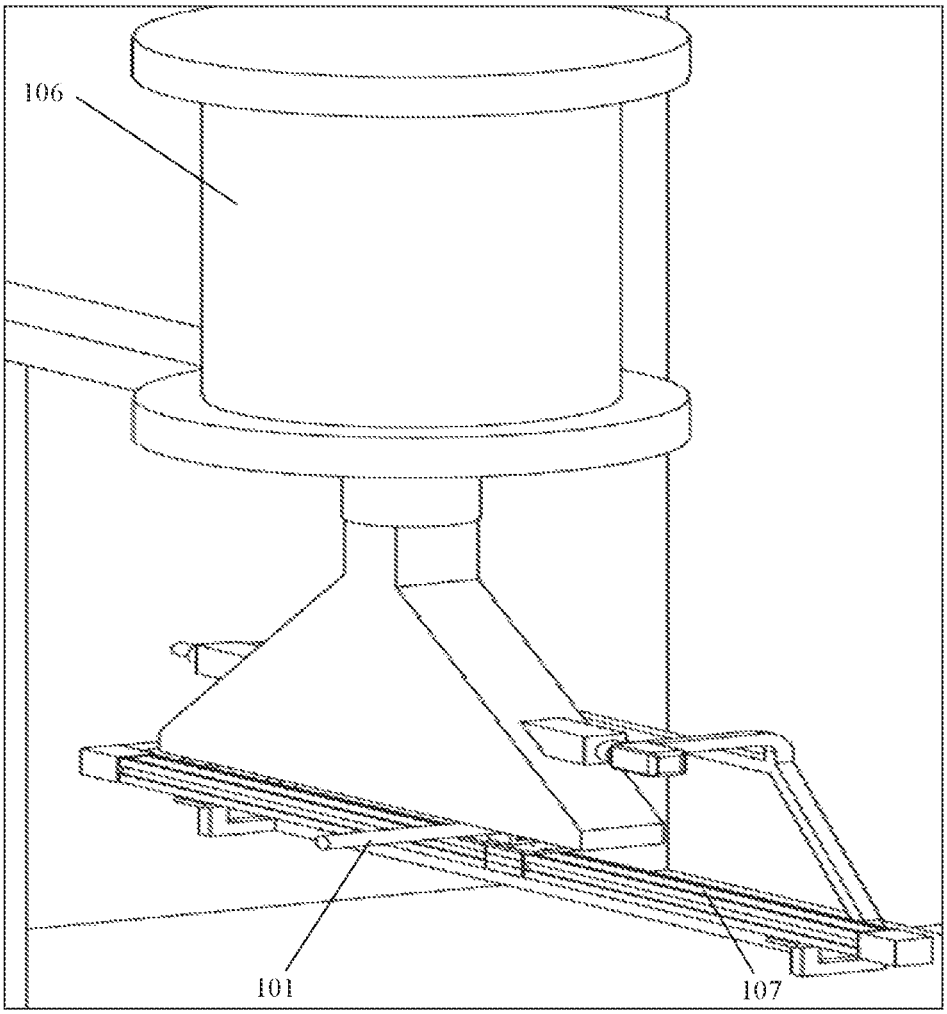
FIG. 11 is a diagram of structures of an electron collecting device and an electron collecting scaffold according to an embodiment herein.
Figure 12:
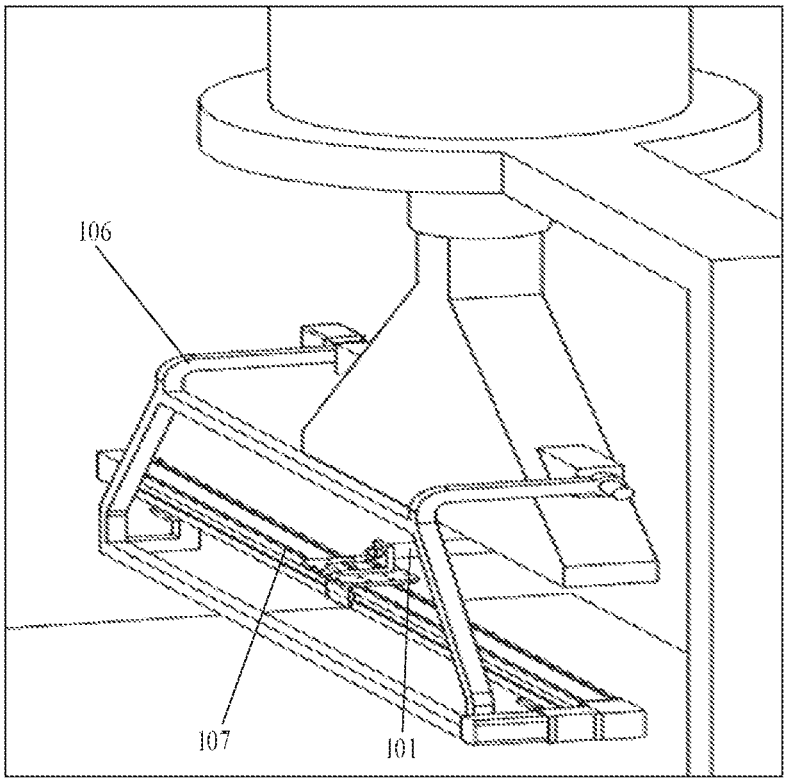
FIG. 12 is a diagram of structures of an electron collecting device and an electron collecting scaffold according to an embodiment herein.

As shown in FIG. 11 and FIG. 12, the system of electron irradiation may further include an electron collecting scaffold and a driving device.

The driving device may be connected to the electron collecting device 101. The driving device may be arranged for providing the electron collecting device 101 with a driving force.

The electron collecting device 101 may be installed on the electron collecting scaffold 106. Driven by the driving force, the electron collecting device may move based on the electron collecting scaffold 106.

The system may include an electron collecting scaffold 106. The electron collecting device 101 may be installed on the electron collecting scaffold. The electron collecting device 101 may move driven by the driving force provided by the driving device. This is equivalent to providing multiple electron collecting devices 101 at different locations of the electron collecting scaffold 106. In embodiments herein, one mobile electron collecting device 101 instead of multiple electron collecting devices 101 may collect the strength of irradiation of the beam of electrons at different locations, thereby reducing the number of electron collecting devices 101, lowering hardware cost of the system.

The electron collecting scaffold 106 may be a cross or a rectangular ring scaffold. The electron collecting device 101 may move in two dimensions where electrons are to be collected. The two dimensions may be perpendicular to each other, or may form a bevel.

The electron collecting scaffold 106 may include an electron collecting rail 107.

The electron collecting device 101 may be movably installed on the electron collecting rail 107.

The electron collecting device may be allowed of a one-dimensional movement along the electron collecting rail 107.

The electron collecting scaffold may include an electron collecting rail 107. The electron collecting device 101 may be hung over the electron collecting rail 107. The electron collecting rail 107 may include a rail groove. The electron collecting device 101 may move on the rail groove. Or, the electron collecting rail 107 may be a rail pole. The electron collecting device 101 may move while covering the rail pole like a sleeve.

The driving device may include a stepper motor.

The driving device may be an electric driving device, a hydraulic driving device, a pneumatic driving device, etc.

The driving device may be an electric driving device and a stepper motor. The stepper motor may be of a simple structure and low hardware cost.

The electron collecting scaffold 106 may be movably installed on an installation location of an irradiation processing production line.

If the movable scaffold is located at a first location, the electron collecting device 101 may be located on a processing location of the irradiation processing production line, and may be arranged for detecting the strength of the beam of electrons for irradiation processing. A product may be processed at the processing location.

If the movable scaffold is located at a second location, the electron collecting device 101 may be located off the processing location.

In the embodiment, the electron collecting scaffold 106 may be movably installed on an irradiation processing production line. Such movable installation may allow the electron collecting scaffold 106 to move on the irradiation processing production line. For example, the electron collecting scaffold 106 may be moved, such that the electron collecting device 101 is moved from the location A to the location B. The electron collecting device 101 may be driven by the electron collecting scaffold 106 to get in and get out of the processing location where a product is to be processed. If the electron collecting device 101 has entered the processing location, then the electron collecting device instead of the product being processed may experience irradiation of the beam of electrons. If the electron collecting device has left the processing location, then the processing location becomes available, so that a product to be processed may be placed there and irradiation processing may continue.

The electron collecting scaffold 106 may be, but is not limited to, a mechanical arm capable of carrying the electron collecting device 101 to move.

Figure 10:
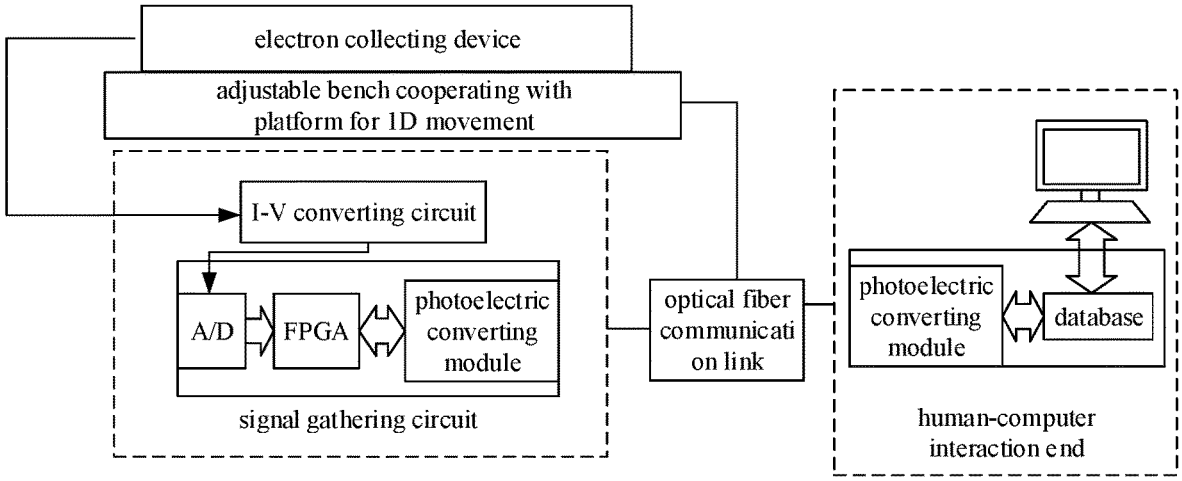
FIG. 10 is a diagram of a structure of an electron beam detecting device according to an embodiment herein.

As shown in FIG. 10, the electron collecting device may be installed on an adjustable bench cooperating with the electron collecting rail on the electron collecting scaffold in one-dimensional movement. The gathering box may include an I-V converting circuit (which may correspond to the current to voltage converting circuit), a digital to analog converter (A/D), a Field-Programmable Gate Array (FPGA), and a photoelectric converting module, composing the signal sampling circuit in the sampling box. The signal sampling circuit may exchange data with the human-computer interaction end (corresponding to the controller) inside the control room through the optical fiber communication link formed by the optical fiber. For example, data transmitted through the optical fiber communication link may be converted into an electric signal through the photoelectric converting module. The electric signal may then be stored in a database.

A specific example may be provided as follows with reference to any aforementioned embodiment.

According to the example, as shown in FIG. 8 to FIG. 14, the structure of the device for detecting online the degree of uniformity of irradiation of a strong beam of electrons of high current may mainly include an electron collecting platform, a local sampling box, a communicating box, a human-computer interaction end, and a related connecting optical fiber. The electron collecting platform and the local sampling box may be placed inside the shield room. The other components may be placed in the control room. The components in the two room may be connected by the optical fiber passing through the wall.

The degree of uniformity of irradiation of a strong beam of electrons of high current may be detected online as follows.

(1) In preparation, the electron collecting platform may be laid down by instructions of the human-computer interaction end. A beam of electrons may illuminate an electron probe.

(2) In scan, one dimensional scanning movement of the probe may be started.

(3) In processing, an electric signal may be processed by the local sampling box. The electric signal may be converted into a digital signal. The digital signal may be transmitted to the human-computer interaction end through the communicating box.

(4) In display, the human-computer interaction end may display information on a screen.

There may be 5 core components of the device of irradiation of liquid continuous seal, with the structure as shown in FIG. 10. The device may include an electron collecting device, which may convert a restrained beam into an electric signal. The device may include an adjustable bench for one-dimensional movement, which may control the location of the probe to control movement of online measurement. The device may include a signal gathering circuit, which may process, such as amplify, filter, etc., the signal of the probe. The device may include an optical fiber communication link, which may isolate the high voltage of the beam restraining section and transmit the measurement signal. The device may include a human-computer interaction end, which may provide a convenient human-computer interaction interface, facilitate controlling the gathering process, and acquire measurement data.

To implement online measurement, the system may employ the adjustable bench for one-dimensional movement as shown in FIG. 11 to FIG. 14. The electron collecting device may be secured on the one dimensional rail by screw. The rail may move back and forth in one direction under control of the stepper motor. The bench for one-dimensional movement may be secured on the flip scaffold. The flip scaffold may be connected to the scanning box through a motor of a large torque. The flip scaffold may be flipped by controlling the steering gear. During normal operation, the entire device may be flipped beside the scanning box. when measurement is required, the steering gear may be controlled remotely to flip the device to place it under the scanning box.

Figure 13:
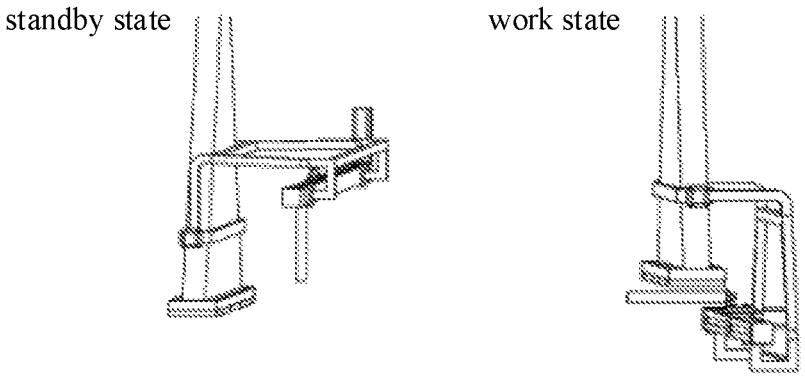
FIG. 13 is a diagram of structures of an electron collecting device and an electron collecting scaffold according to an embodiment herein.

Thus, as shown in FIG. 13, in a work state, the flip scaffold (a movable scaffold) may flip the electron collecting device to place it on the processing location of the irradiation production line. The processing location may be where a product is to be irradiated. In a standby state, the flip scaffold may flip the electron collecting device to withdraw it from the processing location where a product is to be irradiated, to allow normal irradiation processing.

Figure 14:
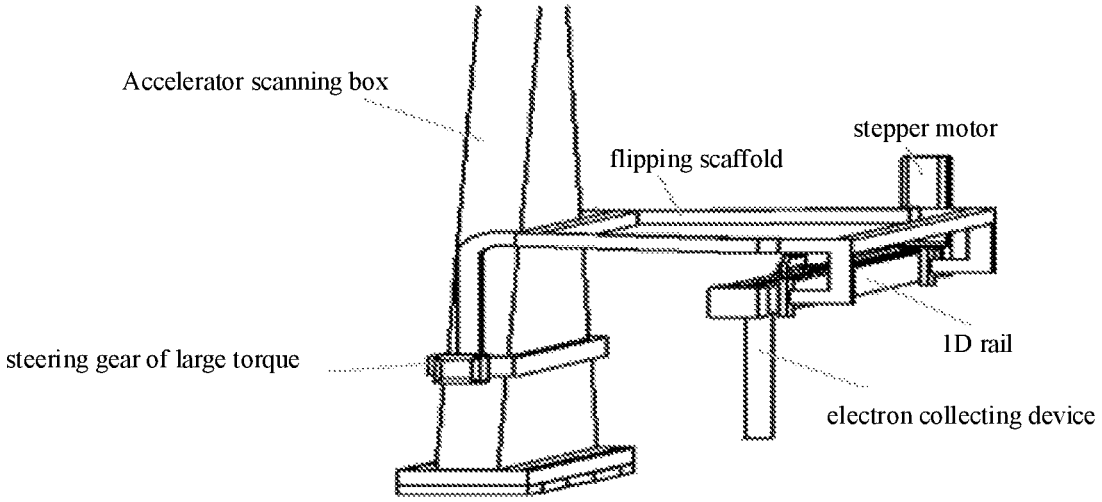
FIG. 14 is a diagram of structures of an electron collecting device and an electron collecting scaffold according to an embodiment herein.

As shown in FIG. 14, an electron beam detecting device may include an accelerator scanning box, a flip scaffold, a steering gear of a large torque, a one dimensional rail, an electron collecting device, and a stepper motor.

The accelerator scanning may be arranged for accelerating a beam of electrons.

The steering gear of a large torque may be connected to the flip scaffold. The steering gear may be arranged for providing the driving force that drives the flip scaffold to flip.

The one dimensional rail may be an electron collecting rail provided on the flip scaffold. The one dimensional rail may serve for one dimensional linear movement of the electron collecting device along the one dimensional rail.

The electron collecting device may be movably installed on the one dimensional rail.

The stepper motor may be a driving device for driving the electron collecting device. The stepper motor may convert electric energy into mechanical energy by rotating a motor per se, and drive the electron collecting device.

Note that in embodiments provided herein, the disclosed equipment and method may be implemented in other ways. The described equipment embodiments are merely exemplary. For example, the unit division is merely logical function division and can be other division in actual implementation. For example, multiple units or components can be combined, or integrated into another system, or some features/characteristics can be omitted or skipped. Furthermore, the coupling, or direct coupling or communicational connection among the components illustrated or discussed herein may be implemented through indirect coupling or communicational connection among some interfaces, equipment, or units, and may be electrical, mechanical, or in other forms.

The units described as separate components may or may not be physically separated. Components shown as units may be or may not be physical units; they may be located in one place, or distributed on multiple network units. Some or all of the units may be selected to achieve the purpose of a solution of the embodiments as needed.

In addition, functional units in embodiments herein may all be integrated in one processing unit, or exist as separate units respectively; or two or more such units may be integrated in one unit. The integrated unit may be implemented in form of hardware, or hardware plus software functional unit(s).

A person having ordinary skill in the art may understand that all or part of the steps of the embodiments may be implemented by instructing a related hardware through a program, which program may be stored in a transitory or non-transitory computer-readable storage medium and when executed, execute steps including those of the embodiments. The computer-readable storage medium may be various media that can store program codes, such as mobile storage equipment, Read Only Memory (ROM), Random Access Memory (RAM), a magnetic disk, a CD, and/or the like.

What described are merely implementations of the examples and are not intended to limit the scope of the examples. Any modification, equivalent replacement, and/or the like made within the technical scope of the examples, as may occur to a person having ordinary skill in the art, shall be included in the scope of the examples. The scope of the examples thus should be determined by the claims.

What is claimed is:

1. A system of electron irradiation, comprising an electron accelerator and an electron beam focusing device, wherein the electron accelerator is arranged for emitting and accelerating a beam of electrons, wherein the electron beam focusing device is located at a rear end of the electron irradiation and comprises a beam restraining rail and 2n+1 sets of magnetic poles, wherein the beam restraining rail forms a beam restraining channel through which the beam of electrons are to pass, wherein the 2n+1 sets of magnetic poles are installed on the beam restraining rail and are distributed at different locations of the beam restraining channel, wherein an nth set of magnetic poles of the 2n+1 sets of magnetic poles are arranged for performing, on the beam of electrons, focusing in a first direction, wherein an (n+1)th set of magnetic poles of the 2n+1 sets of magnetic poles are arranged for performing, on the beam of electrons, focusing in a second direction, wherein the second direction is perpendicular to the first direction, wherein the n is a positive integer.

2. The system of claim 1, wherein the 2n+1 sets of magnetic poles comprise a first set of magnetic poles, a second set of magnetic poles, and a third set of magnetic poles, wherein the first set of magnetic poles are arranged for performing, on the beam of electrons, first-time focusing in the first direction, wherein the second set of magnetic poles are arranged for performing, on the beam of electrons, focusing in the second direction, wherein the third set of magnetic poles are arranged for performing, on the beam of electrons, second-time focusing in the first direction.

3. The system of claim 2, wherein at least part of the 2n+1 sets of magnetic poles are movably installed on the beam restraining rail, with a spacing between any two neighbor sets of magnetic poles being adjustable.

4. The system of claim 2, wherein the sets of magnetic poles are sets of quadrupole magnetic poles.

5. The system of claim 1, wherein at least part of the 2n+1 sets of magnetic poles are movably installed on the beam restraining rail, with a spacing between any two neighbor sets of magnetic poles being adjustable.

6. The system of claim 5, wherein of the 2n+1 sets of magnetic poles, a second set of magnetic poles and/or a third set of magnetic poles are movably installed on the beam restraining rail, wherein different locations of the second set of magnetic poles on the beam restraining rail correspond respectively to different first spacings between the second set of magnetic poles and a first set of magnetic poles of the 2n+1 sets of magnetic poles, and/or wherein different locations of the third set of magnetic poles on the beam restraining rail correspond respectively to different second spacings between the third set of magnetic poles and the second set of magnetic poles.

7. The system of claim 5, wherein different spacings between a first set of magnetic poles and a last set of magnetic poles of the 2n+1 sets of magnetic poles correspond respectively to different lengths of a drift space in the beam restraining channel in which the beam of electrons drift.

8. The system of claim 1, wherein the sets of magnetic poles are sets of quadrupole magnetic poles.

9. The system of claim 8, wherein the sets of quadrupole magnetic poles are composed of permanent magnets.

10. The system of claim 9, wherein the permanent magnets are made from NdFeB.

11. The system of claim 1, wherein a permanent magnet of the 2n+1 sets of magnetic poles is installed on the beam restraining rail through a yoke ring.

12. The system of claim 11, wherein the yoke ring is made by connecting multiple yokes, wherein different connection locations between two neighbor yokes correspond respectively to different diameters of the yoke ring.

13. The system of claim 1, further comprising an electron beam detecting device arranged for detecting the beam of electrons.

14. The system of claim 13, wherein the electron beam detecting device comprises an electron collecting device, a sampling box, a communicating box, and a controller, wherein the electron collecting device is located, together with the electron accelerator, inside a shield room, and is arranged for acquiring a first signal by detecting a strength of the beam of electrons radiated by the electron accelerator, wherein the sampling box is located inside the shield room, is connected to the electron collecting device, and is arranged for receiving the first signal and converting the first signal into a second signal which is an optical signal that reflects a degree of uniformity of irradiation of the beam of electrons, wherein the communicating box is located outside the shield room, is connected to the sampling box through an optical fiber, and is arranged for receiving the second signal through the optical fiber and converting the second signal into a third signal which is an electric signal, wherein the controller is located outside the shield room, is connected to the communicating box, and is arranged for receiving the third signal and controlling detection of the beam of electrons.

15. The system of claim 14, wherein the communicating box and the controller are located inside a control room, wherein a metal shield wall is provided between the control room and the shield room, wherein a perforation through which the optical fiber is to pass is provided on the metal shield wall.

16. The system of claim 14, wherein the sampling box comprising a current to voltage converting circuit, a digital to analog converter, a sampling chip, and a photoelectric converting circuit, wherein the current to voltage converting circuit is connected to the electron collecting device, and is arranged for receiving the first signal, which is a current signal, and converting the current signal into a voltage signal, wherein the digital to analog converter is connected to the current to voltage converting circuit, and is arranged for converting the voltage signal, which is an analog signal, into a digital signal, wherein the sampling chip is connected to the digital to analog converter, and is arranged for converting the digital signal into a third signal that reflects the degree of uniformity of irradiation of the beam of electrons, wherein the photoelectric converting circuit is connected to the sampling chip, and is arranged for converting the third signal into the second signal which is the optical signal.

17. The system of claim 14, further comprising an electron collecting scaffold and a driving device, wherein the driving device is connected to the electron collecting device, and is arranged for providing the electron collecting device with a driving force, wherein the electron collecting device is installed on the electron collecting scaffold, wherein driven by the driving force, the electron collecting device is movable based on the electron collecting scaffold.

18. The system of claim 17, wherein the electron collecting scaffold comprises an electron collecting rail, wherein the electron collecting device is movably installed on the electron collecting rail, and is allowed of a one-dimensional movement along the electron collecting rail.

19. The system of claim 18, wherein the driving device comprises a stepper motor.

20. The system of claim 19, wherein the electron collecting scaffold is movably installed on an installation location of an irradiation processing production line, in response to the electron collecting scaffold being located at a first location, the electron collecting device is located on a processing location of the irradiation processing production line, and is arranged for detecting the strength of the beam of electrons for irradiation processing, wherein the processing location is where a product is to be processed, in response to the electron collecting scaffold being located at a second location, the electron collecting device is located off the processing location.

* * * * *